US006626199B2

(12) United States Patent
Lin et al.

(10) Patent No.: US 6,626,199 B2
(45) Date of Patent: Sep. 30, 2003

(54) FLATTENED AND SHORTENED UMBRELLA

(75) Inventors: Chung-Kuang Lin, Taipei Hsien (TW); Jung-Jen Chang, Taipei Hsien (TW)

(73) Assignee: Fu Tai Umbrella Works, Ltd., Taipei Hsien (TW)

( * ) Notice: Subject to any disclaimer, the term of this patent is extended or adjusted under 35 U.S.C. 154(b) by 47 days.

(21) Appl. No.: 10/002,230

(22) Filed: Dec. 5, 2001

(65) Prior Publication Data

US 2003/0102020 A1 Jun. 5, 2003

(51) Int. Cl.[7] ..... A45B 25/00
(52) U.S. Cl. ..... 135/28; 135/41; 135/20.1
(58) Field of Search ..... 135/28, 25.1, 25.3, 135/31, 29, 15.1, 39, 41, 20.1

(56) References Cited

U.S. PATENT DOCUMENTS 5,533,535 A * 7/1996 Lin et al. ..... 135/20.1
5,706,844 A * 1/1998 Lin et al. ..... 135/25.1
5,791,359 A * 8/1998 Lin et al. ..... 135/24
6,371,141 B1 * 4/2002 Lin et al. ..... 135/28

* cited by examiner

*Primary Examiner*—Carl D. Friedman
*Assistant Examiner*—Jennifer I. Thissell
(74) *Attorney, Agent, or Firm*—Troxell Law Office PLLC

(57) ABSTRACT

An umbrella includes: a flat upper notch formed on a top of a central shaft and a flat lower runner slidably held on the central shaft for pivotally securing a plurality of ribs between the upper notch and the lower runner, either the upper notch or lower runner having four ribs pivotally secured to a narrow right side portion of the upper notch or the lower runner, and having three ribs pivotally secured to a narrow left side portion of the upper notch or the lower runner, thereby decreasing the separating angle between every two opposite ribs disposed on a wide front or rear side portion of the upper notch or the lower runner for smoothening the folding operation when closing the umbrella and also for enhancing the strength of the umbrella ribs.

7 Claims, 3 Drawing Sheets

FLATTENED AND SHORTENED UMBRELLA

BACKGROUND OF THE INVENTION

A conventional flat umbrella as shown in FIG. 1 includes six ribs R pivotally secured to an upper notch or lower runner which is formed as a flat rectangular shape with each rib R pivotally held in each pivotal socket N1 and with two opposite side ribs R opened to be limited by a retarding portion L formed on a front or rear wide side portion of the upper notch or lower runner. Since the two ribs as spaced by the retarding portion L at the wide side portion are separated at a big angle (90 degrees), as compared to other smaller angles each defined between every two neighboring ribs R at the narrow side portion, it will influence the smooth folding operation and require further inconvenient pleating of the umbrella cloth as disposed on the unevenly spaced ribs when closing the umbrella. Meanwhile, the six ribs R should support the whole umbrella cloth, their strength is not enough durable for operating the umbrella.

The present inventor has found the drawbacks of the conventional flat umbrella and invented the present umbrella as flattened and shortened.

SUMMARY OF THE INVENTION

The object of the present invention is to provide an umbrella including: a flat upper notch formed on a top of a central shaft and a flat lower runner slidably held on the central shaft for pivotally securing a plurality of ribs between the upper notch and the lower runner, either the upper notch or lower runner having four ribs pivotally secured to a narrow right side portion of the upper notch or the lower runner, and having three ribs pivotally secured to a narrow left side portion of the upper notch or the lower runner, thereby decreasing the separating angle between every two opposite ribs disposed on a wide front or rear side portion of the upper notch or the lower runner for smoothening the folding operation when closing the umbrella and also for enhancing the strength of the umbrella ribs.

DETAILED DESCRIPTION

Figure 1:
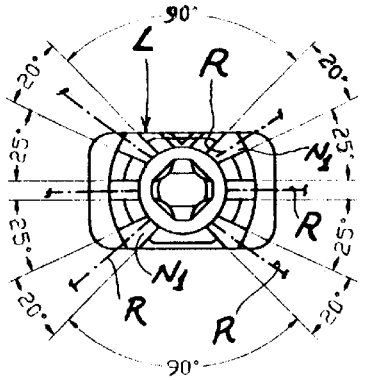
PRIOR ART Fig. 1
FIG. 1 is a plan view of an upper notch of a conventional flat umbrella having six ribs.

As shown in the drawing figures, the present invention comprises: a central shaft 1, a rib assembly 2 pivotally secured to a flat upper notch 3 formed on a top of the shaft 1 and a flat lower runner or runner 4 slidably held on the shaft 1.

The central shaft 1 includes a plurality of tubes telescopically engageable with one another and, for instance, including: a lower tube 11, a first middle tube 12, a second middle tube 13, an upper tube 14 and an uppermost tube 15 telescopically engaged for forming a shaft for a penta-fold umbrella. Each tube may be formed with one or plural concave quadrants recessed inwardly towards a central axis of the shaft 1 so that every two neighboring tubes may be telescopically engaged without being twisted. However, the cross section of each tube is not limited in this invention.

The rib assembly 2 may be formed for quadruple or penta folds or any other multiple folds of a foldable umbrella, also not limited in the present invention.

Either upper notch 3 or lower runner 4 is formed as a flat shape such as a rectangular or elliptic shape.

Either notch 3 or runner 4 may be secured thereon a restoring spring 5 for resiliently restoring the ribs of the rib assembly 2 from a flat side to a narrow side which will be hereinafter described with reference to the accompanying drawing figures such as FIGS. 7 and 8.

Figure 5:
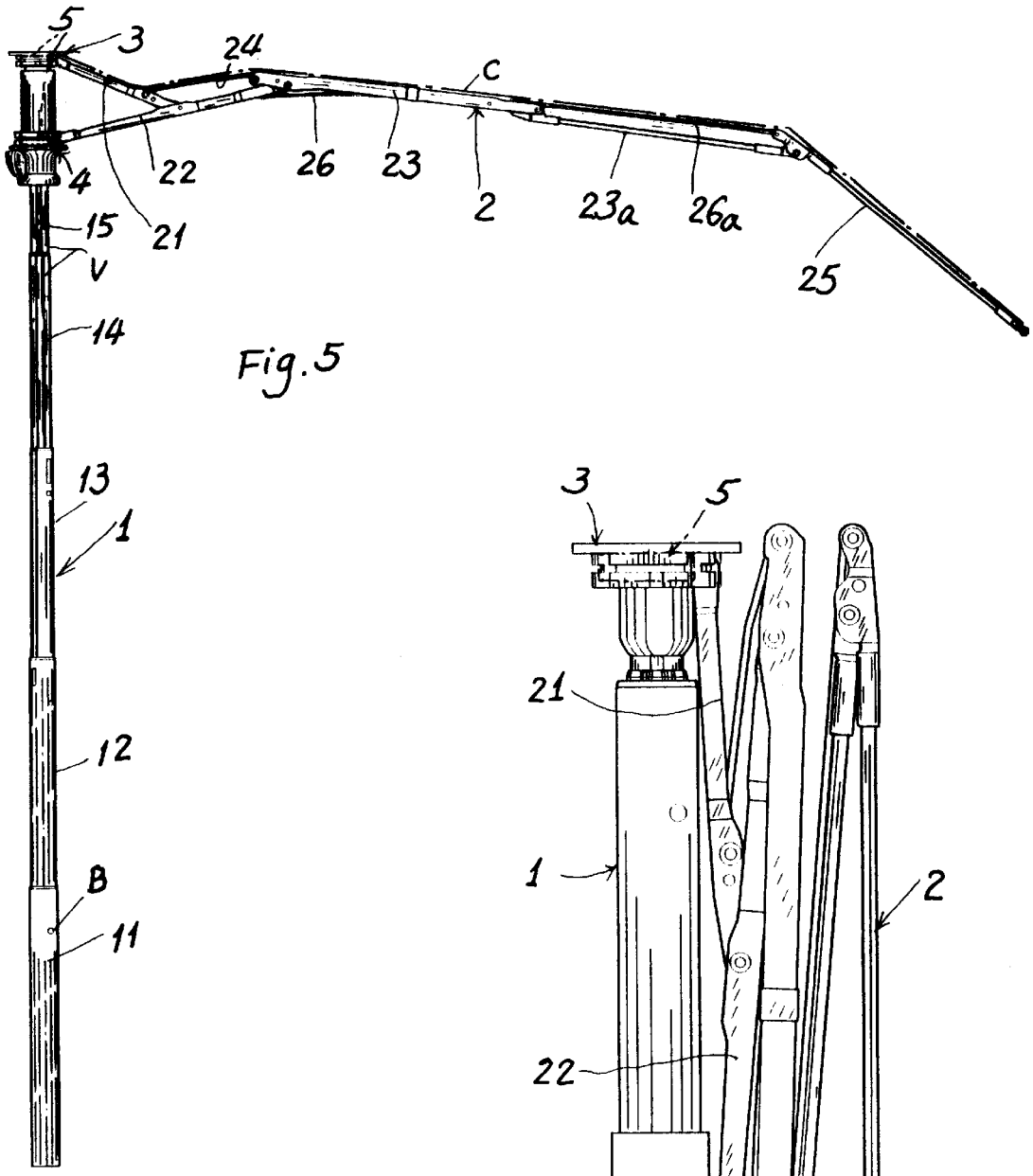
FIG. 5 shows an open umbrella of the present invention.
Figure 6:
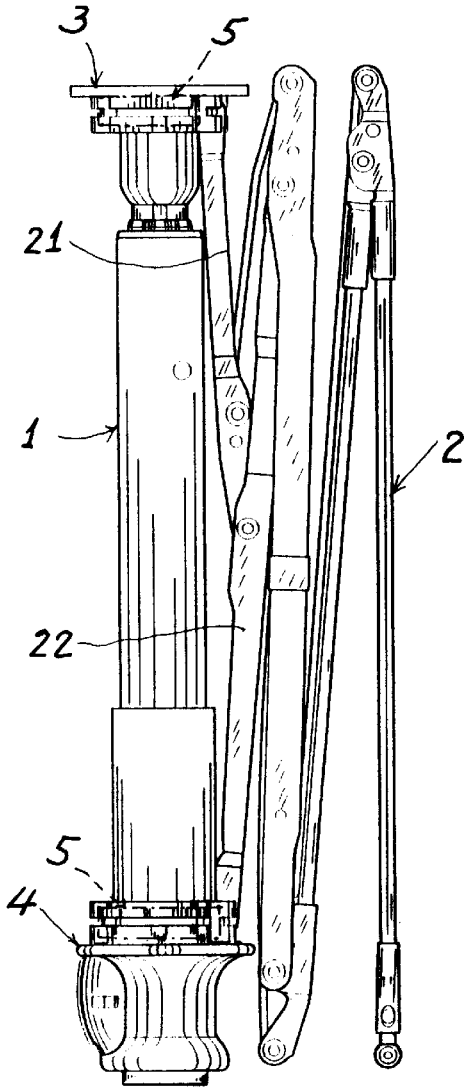
FIG. 6 shows a closed umbrella of the present invention.

The rib assembly 2 for securing an umbrella cloth C, especially as shown in FIGS. 5 and 6, includes: a top rib 21 pivotally secured to the upper notch 3, a stretcher rib 22 pivotally secured to the top rib 21 and the runner 4, an intermediate rib 23 pivotally secured to the stretcher rib 22 and also pivotally secured to the top rib 21 by a connecting rib 24, a tail rib 25 pivotally secured to the intermediate rib 23 by an auxiliary intermediate rib 23*a*, a resilient rib 26 pivotally connected between the stretcher rib 22 and the intermediate ribs 23, 23*a*, and an auxiliary resilient rib 26*a* pivotally connected between the intermediate rib 23 and the tail rib 25.

Figure 2:
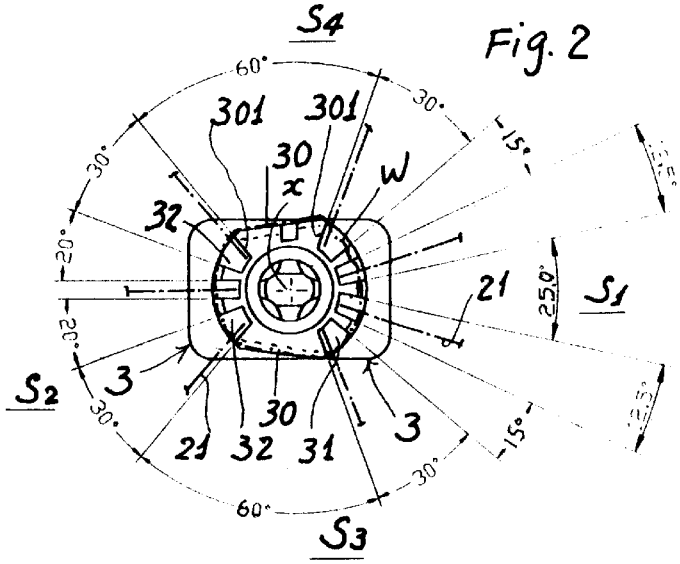
FIG. 2 is a bottom view of an upper notch of the present invention.
Figure 4:
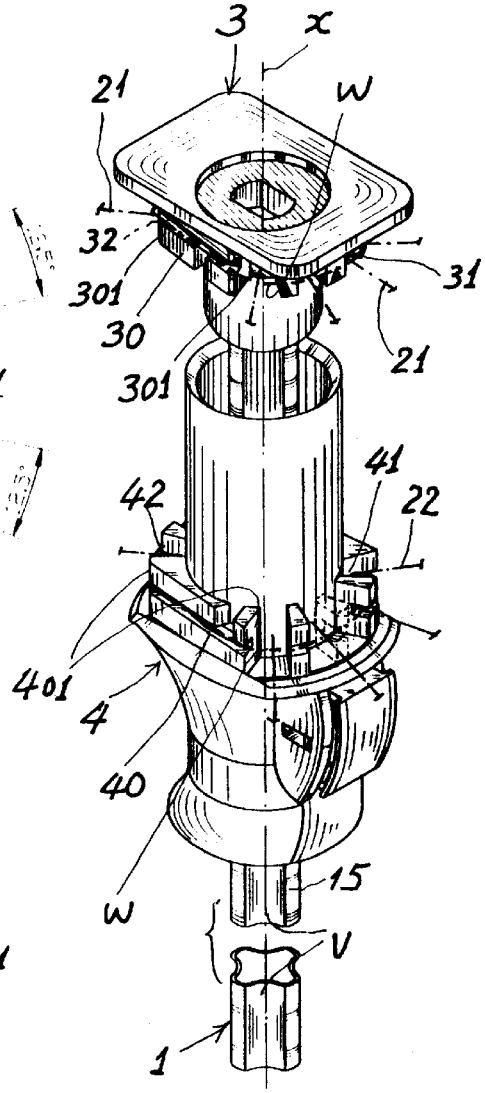
FIG. 4 is a partial perspective view of the present invention.

The upper notch 3 includes: four top ribs 21 each pivotally secured in a pivoting socket 31 recessed in a first narrow side portion (or a narrow right side portion) S1 of the notch 3 as shown in FIGS. 2, 4; three top ribs 21 each pivotally secured in another pivoting socket 32 recessed in a second narrow side portion (or a left narrow side portion) S2 of the notch 3; a first wide side portion (or a front wide side portion) S3 and a second wide side portion (or a rear wide side portion) S4 respectively formed on opposite wide side portions of the upper notch 3, with each wide side portion (S3 or S4) having a retarding block 30 formed on the notch 3 between the first and second narrow side portions S1, S2 and each retarding block 30 having a pair of retarding surfaces 301 radially formed on opposite side surfaces of the retarding block 30 about a longitudinal axis X defined at a longitudinal center of the notch 3, the runner 4 and the shaft 1 for limiting two neighboring top ribs 21 adjacent to the wide side portion when radially extended when opening the umbrella (FIG. 2) and the two retarding surfaces 301 preferably defining an acute angle of 60 degrees (or less) between the opposite retarding surfaces 301. A wire W is wound and fastened on the upper notch 3 to serve as a "pivot" of the pivoting sockets 31, 32 for pivotally securing the ribs 21 on the wire W.

Figure 3:
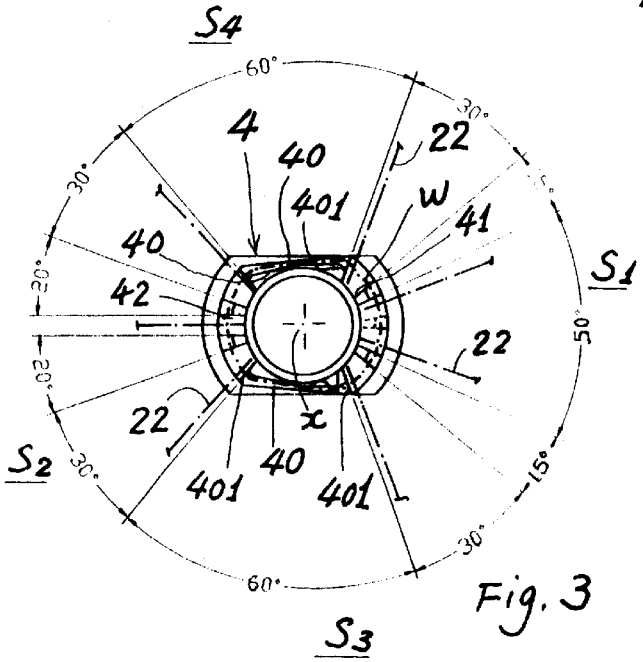
FIG. 3 is a top view of a lower runner of the present invention.

The lower runner 4 includes: four stretcher ribs 22 each pivotally secured in a pivoting socket 41 recessed in a first narrow side portion (or a narrow right side portion) S1 of the runner 4 as shown in FIGS. 3, 4; three stretcher ribs 22 each pivotally secured in another pivoting socket 42 recessed in a second narrow side portion (or a left narrow side portion) S2 of the runner 4; a first wide side portion (or a front wide side portion) S3 and a second wide side portion (or a rear wide side portion) S4 respectively formed on opposite side portions of the lower runner 4, with each wide side portion (S3 or S4) having a retarding block 40 formed on the runner 4 between the first and second narrow side portions S1, S2 and each retarding block 40 having a pair of retarding surfaces 401 radially formed on opposite side surfaces of the retarding block 40 about a longitudinal axis X defined at a longitudinal center of the notch 3, the runner 4 and the shaft 1 for limiting two neighboring stretcher ribs 22 at the wide side portion when radially extended when opening the umbrella (FIG. 3) and the two retarding surfaces 401 preferably defining an acute angle of 60 degrees (or less) between the opposite retarding surfaces 401. A wire W is also wound and fastened on the runner 4 to serve as a "pivot" for pivotally securing the stretcher ribs 22 on the wire W.

The acute angle of 60 degrees separated by the two opposite ribs (21 or 22) as spaced by each retarding block (30 or 40) of the present invention is less than the right angle of 90 degrees as defined by two ribs of the conventional flat umbrella having six ribs pivotally secured to the upper notch or lower runner (as shown in FIG. 1). The degree difference between the acute angle (60 degrees) as defined by the two ribs (21 or 22) at the wide side (S3 or S4) and the other acute angle (such as 20°, 25° or 30°) defined by the other two neighboring ribs at the narrow side (S1 or S2) of this invention has been decreased from that (degree difference) between the right angle (90°) at the wide side and the other acute angle (20° or 25°) at the narrow side of the conventional flat umbrella as shown in FIG. 1, thereby smoothening the folding operation when closing the umbrella since the umbrella cloth of the present invention is disposed on the ribs more evenly than the prior art as shown in FIG. 1.

The angle as defined in every two neighboring ribs is not limited in the present invention.

The mechanical strength of the present invention may also be enhanced since total seven ribs (21 or 22) are provided to support the umbrella cloth, thereby being stronger than that of the conventional flat umbrella having six ribs as shown in FIG. 1.

If the flat umbrella is inferentially formed to have eight ribs pivotally secured to the notch or runner, the umbrella cloth can be evenly disposed on opposite sides (each side having four ribs), it will increase production cost and total weight and volume of the umbrella, thereby being unsatisfactory for a pocketable umbrella.

Figure 7:
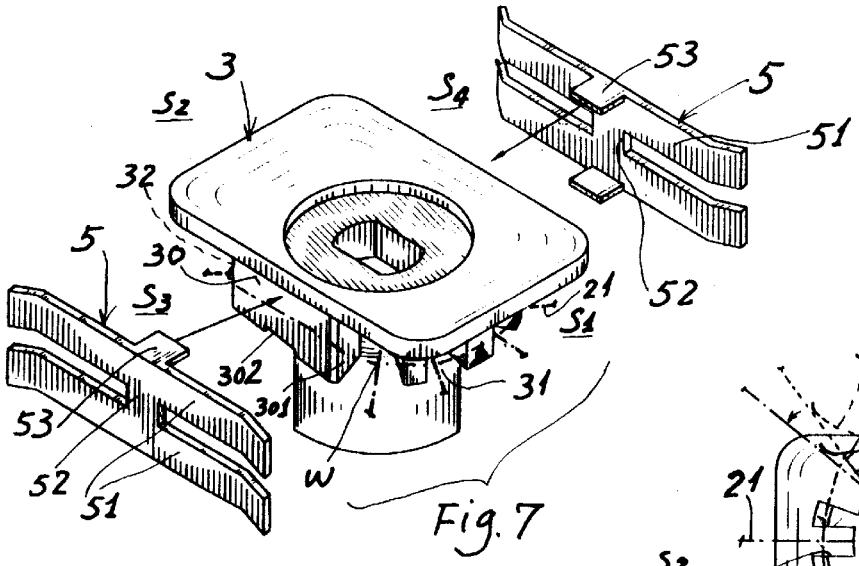
FIG. 7 is a perspective view of the upper notch of the present invention.
Figure 8:
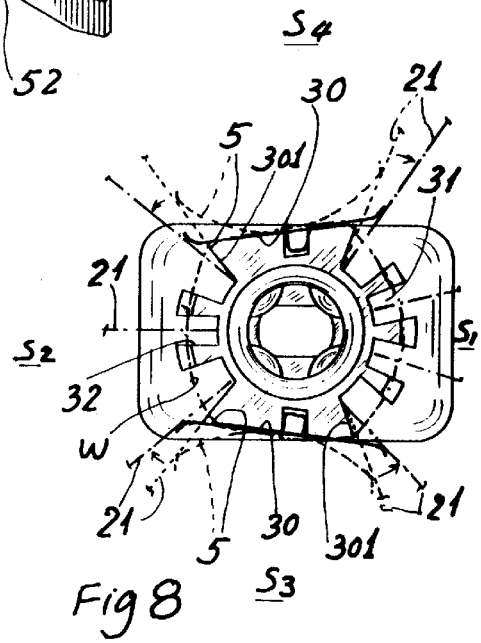
FIG. 8 is a bottom-view illustration of the upper notch showing the effect of the restoring spring of the present invention.

When closing the umbrella of the present invention, a restoring spring 5 may be provided (formed, secured or fastened) on each wide side portion S3 or S4 of the upper notch 3 (or lower runner 4) as shown in FIGS. 7, 8 for resiliently restoring or biasing the opposite ribs (21 or 22) from the wide side portion (S3 or S4) towards the narrow side portion (S1 or S2) when an open umbrella is closed (as from dotted line to solid line as shown in FIG. 8) for helping the folding of the ribs towards the narrow side portions S1, S2 to become a flat pocketable umbrella as effected by the present invention.

Each restoring spring 5 includes: at least a spring plate (or two spring plates) 51 having a length protruding from the wide side portion S3 or S4 of the notch 3 (or runner 4) towards two narrow side portions S1, S2 of the notch 3 (or runner 4) for operatively biasing two ribs 21 (or 22), which have been extended, when opening the umbrella, to rest upon two retarding surfaces 301 (or 401) of each retarding block 30 (or 40), from the wide side portion S3 or S4 towards the two narrow side portions S1, S2 when closing the umbrella; a fastening portion 52 formed on a middle portion of the spring plate 51 to be fastened to the retarding block 30 (or 40) by the wire W as wound on the notch 3 (or runner 4); and at least a lug (or two lugs) 53 formed on the spring plate 51 and inserted into a lug recess 302 formed in the notch 3 (or runner 4) for firmly securing the spring 5 on the notch 3 (or runner 4).

The restoring spring 5 may be modified to be other preferred restoring members for normally restoring the ribs from the wide side portion towards the narrow side portion of the notch 3 or runner 4 to be a flat pocketable umbrella when folded.

The aforementioned structure or elements of the present invention are provided to flatten the umbrella to be a mini flat pockable umbrella. Besides, the present invention may be further shortened by the coupling mechanism or device as below-mentioned to form a really "Flattened and Shortened Umbrella" as taught by the present invention.

Figure 9:
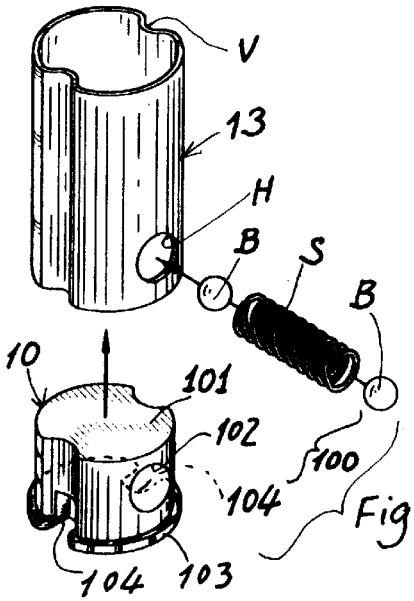
FIG. 9 is an exploded view of the elements of a coupling mechanism for coupling the tubes of the central shaft of the present invention.
Figure 11:
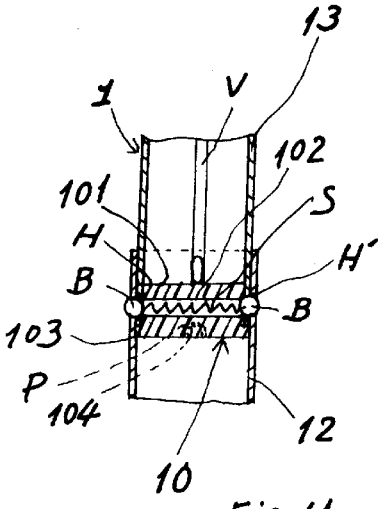
FIG. 11 is a sectional drawing of two tubes of the central shaft coupled with each other in accordance with the present invention.
Figure 10:
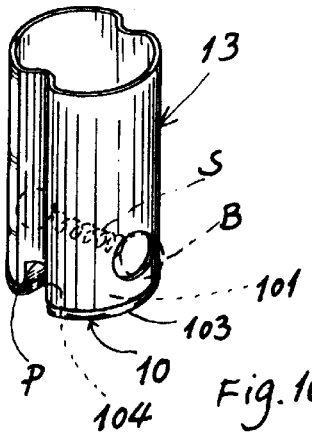
FIG. 10 is an illustration when assembling the elements of FIG. 9.

As shown in FIGS. 9~11, the tube (15, 14, 13, 12) of the central shaft 1 may be plugged therein with a bottom plug 10 of a shortened coupling device 100 of the present invention for coupling two neighboring tubes telescopically engageable with each other as shown in FIG. 11.

The shortened coupling device 100 includes: a bottom plug 10 inserted or fixed in a bottom portion of an inner tube of the central shaft 1; and a pair of balls B resiliently tensioned by a tension spring S held in the bottom plug 10, with each ball B engaged with an inner ball hole H of the inner tube (for instance, the numeral "13" of FIG. 11) and an outer ball hole H' of an outer tube (for instance, the numeral "12" of FIG. 11), whereby when urged by the tension spring S, the two balls B will couple the inner tube with the outer tube of the shaft 1 when extending the shaft when opening the umbrella. The ball B is outwardly retarded by the outer ball hole H' (having a smaller diameter than that of the ball) of the outer tube.

The bottom plug 10 as shown in FIGS. 9, 10 includes a short stem 101 embedded in a bottom hole (or hole) formed in the inner tube, a spring hole 102 transversely formed in the short stem 101 for holding the tension spring S in the spring hole 102, a flange 103 formed on a base of the short stem 101 to be secured to a bottom periphery of the inner tube having a diameter as same as an outside diameter of the inner tube, and a pair of slots 104 notched inwardly in a bottom portion of the plug 10; whereby upon insertion of the plug 10 into the bottom hole of the inner tube, the inner tube may be pressed or crimped inwardly to form a pair of pressing portions P each pressing portion P snugly engaged with each slot 104 of the plug 10 to firmly fix the plug 10 in the inner tube.

The present invention may be modified without departing from the spirit and scope of the present invention.

We claim:

1. A flattened and shortened umbrella comprising:

a central shaft including a plurality of tubes telescopically engageable with one another having at least an inner tube and an outer tube telescopically engageable with each other as coupled by a shortened coupling device;

a rib assembly including at least a top rib pivotally secured to a flat upper notch formed on a top of the central shaft, and a stretcher rib pivotally secured between the top rib and a flat lower runner slidably held on said central shaft; having an umbrella cloth secured on said rib assembly;

each said upper notch and each said lower runner formed as a flat shape selected from a rectangular shape and an elliptic shape, including a first and a second narrow side portion respectively disposed on a right and a left side of each said notch and each said runner; and a first and second wide side portion respectively disposed on a front and a rear side of each said notch and said runner; having four top ribs pivotally secured to said first narrow side portion of said upper notch and having four stretcher ribs pivotally secured to said first narrow side portion of said lower runner; and having three top ribs pivotally secured to said second narrow side portion of said upper notch; and having three stretcher ribs pivotally secured to said second narrow side portion of said lower runner; whereby upon extending of said ribs from two said narrow side portions towards two said wide side portions when opening the umbrella, every two neighboring ribs at each said wide side portion define an acute angle between said two neighboring ribs; and a restoring spring secured on each said wide side portion and operatively restoring and biasing said two neighboring ribs from said wide side portion towards two said narrow side portions for helping folding of the ribs from an open umbrella to a folded umbrella when closing the umbrella.

2. An umbrella according to claim 1, wherein each said wide side portion includes a retarding block formed between the first and second narrow side portions and each said retarding block having a pair of retarding surfaces radially formed on opposite side surfaces of the retarding block about a longitudinal axis X defined at a longitudinal center of the shaft for limiting two said neighboring ribs when radially extended when opening the umbrella and the two said retarding surfaces defining an acute angle between the two retarding surfaces.

3. An umbrella according to claim 1, wherein said acute angle is 60 degrees.

4. An umbrella according to claim 1, wherein said restoring spring includes: at least a spring plate having a length protruding from the wide side portion towards two narrow side portions for biasing two ribs, which have been extended to rest upon two retarding surfaces of each retarding block formed on each said wide side portion when opening the umbrella, from the wide side portion towards the two narrow side portions when closing the umbrella; a fastening portion formed on a middle portion of the spring plate to be fastened to the retarding block by a wire as wound on said notch or said runner; and at least a lug formed on the spring plate and inserted into a lug recess formed in said wide side portion.

5. An umbrella according to claim 1, wherein said shortened coupling device includes: a bottom plug fixed in a bottom portion of said inner tube of the central shaft; and a pair of balls resiliently tensioned by a tension spring held in the bottom plug, with each said ball engaged with an inner ball hole of the inner tube and an outer ball hole of said outer tube, whereby when urged by the tension spring, the two balls will couple the inner tube with the outer tube when opening the umbrella for extending said tubes.

6. An umbrella according to claim 5, wherein said bottom plug includes a short stem embedded in a bottom hole formed in the inner tube, a spring hole transversely formed in the short stem for holding the tension spring in the spring hole, a flange formed on a base of the short stem to be secured to a bottom periphery of the inner tube and having a diameter of said flange as same as an outside diameter of the inner tube, and a pair of slots notched inwardly in a bottom portion of the plug; whereby upon insertion of the plug into the bottom hole of the inner tube, the inner tube is pressed inwardly to form a pair of pressing portions each said pressing portion snugly engaged with each said slot of the plug to firmly fix the plug in the inner tube.

7. A flattened umbrella comprising:

a central shaft including a plurality of tubes telescopically engageable with one another;

a rib assembly including at least a top rib pivotally secured to a flat upper notch formed on a top of the central shaft, and a stretcher rib pivotally secured between the top rib and a flat lower runner slidably held on said central shaft; having an umbrella cloth secured on said rib assembly;

each said upper notch and each said lower runner formed as a flat shape selected from a rectangular shape and an elliptic shape, including a first and a second narrow side portion respectively disposed on a right and a left side of each said notch and each said runner; and a first and second wide side portion respectively disposed on a front and a rear side of each said notch and said runner; whereby upon extending of said ribs from two said narrow side portions towards two said wide side portions when opening the umbrella, every two neighboring ribs at each said wide side portion define an acute angle between said two neighboring ribs; and a restoring spring secured on each said wide side portion and operatively restoring and biasing said two neighboring ribs from said wide side portion towards two said narrow side portions for helping folding of the ribs from an open umbrella to a folded umbrella when closing the umbrella.

* * * * *